United States Patent [19]

Steele

[11] Patent Number: 5,067,385

[45] Date of Patent: Nov. 26, 1991

[54] METHOD AND APPARATUS FOR ALIGNING SPIN-STABILIZED SELF-PROPELLED MISSILES

[75] Inventor: Michael F. Steele, Fountain Valley, Calif.

[73] Assignee: Brunswick Corporation, Skokie, Ill.

[21] Appl. No.: 554,556

[22] Filed: Jul. 19, 1990

[51] Int. Cl.[5] ..... F41C 27/06; F41F 3/048; F42B 10/26

[52] U.S. Cl. ..... 89/1.808; 42/105

[58] Field of Search ..... 42/105; 89/1.808, 1.807

[56] References Cited

U.S. PATENT DOCUMENTS

| | | | |
|---|---|---|---|
| 2,968,996 | 1/1961 | Strickland et al. | 89/1.808 |
| 3,245,350 | 4/1966 | Kelly | 89/1.808 |
| 3,267,854 | 8/1966 | Michelson | 89/1.808 |
| 3,554,078 | 1/1971 | Horvath | 89/1.808 |
| 4,395,836 | 8/1983 | Baker et al. | 42/105 |
| 4,403,435 | 9/1983 | Baker et al. | 42/105 |
| 4,406,210 | 9/1983 | Baker et al. | 89/1.808 |

*Primary Examiner*—David H. Brown

*Attorney, Agent, or Firm*—Wood, Phillips, Mason, Recktenwald & Van Santen

[57] ABSTRACT

For use with a launching apparatus for a spin-stabilized self-propelled missile, which includes a rotary missile support defining a spin axis and receiving the missile with a missile axis of rotation, and a spring operative to hold the missile on the missile support, a method and apparatus are provided for aligning the missile axis of rotation with the spin axis. The rotary missile support and missile are supported on a fixture for rotation about the spin axis. The rotary missile support and missile then are rotated relative to the fixture about the spin axis. The amount of eccentricity between the missile axis of rotation and the spin axis is determined. The missile is restrained for single plane motion and is adjustably moved relative to the rotary support to coincidently align the missile axis of rotation with the spin axis. The spring then is tightened to maintain the coincident alignment of the axes.

18 Claims, 5 Drawing Sheets

10
12
14
16
18
19
19a
20
21
22
35
16
28
40
24
58
30
42
56
54
46
52
36
38
50
38
39a
39b
48
53
32
34
10

METHOD AND APPARATUS FOR ALIGNING SPIN-STABILIZED SELF-PROPELLED MISSILES

FIELD OF THE INVENTION

This invention generally relates to the launching of spin-stabilized self-propelled missiles and, particularly, to a method and an apparatus for aligning the missile axis of rotation with the spin axis of the launching apparatus prior to launching.

BACKGROUND OF THE INVENTION

It has become increasingly important to eliminate the features associated with a ballistic trajectory ordinarily followed by rockets and other jet-propelled projectiles, by forming the projectiles as spherical spin-stabilized missiles. The term "spherical" herein and in the claims hereof is being used in a generic sense to mean line-of-sight projectiles or missiles. For instance, in the exemplary embodiment herein, the missile is spherical only in the forward half of the missile, the aft half being substantially conical in shape.

The spherical missile spins about an axis upwardly inclined relative to the intended straight-line path of flight and aligned with the missile propulsion thrust axis. The missile is released following ignition or activation of the propulsion system within the missile. The propulsion is effected by the reaction of the exhaust jet of, for example, a rocket motor housed within the spherical missile shell. Such spherical spin-stabilized missiles often are provided in conjunction with attachments secured to the front end of an assault weapon such as a rifle.

Such spin-stabilized, spherical, self-propelled missiles experience difficulties in achieving missile spin axis alignment during attainment of desired rotational speed and in coordinating the spinning and release of the missile. Release of the missile prior to attainment of adequate rotational speed can result in unstable flight. Delay of release after attainment of adequate rotational speed can result in a loss of propulsion range.

Consequently, attempts have been made to provide means for temporarily restraining and automatically releasing a spin-stabilized self-propelled spherical missile during spin-up. Some such attempts are shown in U.S. Pat. Nos. 3,245,350 to J. A. Kelly, dated Apr. 12, 1966; 3,554,078 to Joseph S. Horvath, dated Jan. 12, 1971; 4,395,836 to Baker et al., dated Aug. 2, 1983; and 4,403,435 to Baker et al., dated Sept. 13, 1983, the latter two patents being assigned to the assignee of this invention. These patents represent a continuing effort to provide workable spherical spin-stabilized missiles. Generally, a fusible link temporarily restrains and automatically releases the spherical missile during spin-up. Hot missile rocket exhaust gas weakens, by heating, and melts the fusible link which, prior to weakening by softening or melting, secures the missile to a rotary support means. Baker U.S. Pat. No. 4,395,836 shows a novel unitary nozzle member having fusible joint means formed integrally therewith, between the missile and the rotary support means. Baker U.S. Pat. No. 4,403,435 shows an improved nozzle assembly including projectile support means having open-ended receptacle means out of which fore and aft sections of the nozzle can move on fusing and separation of the fusible joint means. This patent also shows an improved register section for the missile or nozzle to improve alignment of the missile with the spin axis during initial separation of the fusible joint means.

A somewhat radical departure from the prior art is shown in copending application Ser. No. 195,657, filed May 18, 1988, and assigned to the assignee of the present invention. That invention is directed to a projectile release mechanism wherein a mass is caused to be urged or propelled rearwardly by the gases of the missile or other suitable stored energy mechanism to strike an abutment means on the turbine or rotary means for the missile to cause the rotary means, in its receptacle, to move rapidly away from the missile after separation of the fusible joint means. This allows positive missile retention by the launch system rotary means during coupling fusing and therefore eliminates pointing error tip off forces initiated during the coupling fusing process of prior apparatus. That invention represents a vast improvement in the prior art, in that the missile separates from its turbine assembly in less than 0.5 msec., compared to the 10 msec separation period encountered in earlier designs in the art. This huge reduction in separation time minimizes the transfer of separate impulse forces from the turbine coupling and assembly to the projectile.

However, still further problems have been encountered designing such spin-stabilized self-propelled missile systems, a condition which has been termed a "repointing condition" which is caused by projectile construction static and dynamic unbalances. In other words, the axis of the turbine assembly or rotary missile support means attempts to control the system control spin axis, while the relatively large missile segment of the system attempts to create its own axis of rotation. If these axes are not colinear, the missile tends to wobble during spinup and jump to an unaimed heading upon release. For ease of understanding, it is as if a common screwdriver was bent and rapidly rotated when in use. The missile ends up being repointed to an angle generally equal to one-half of the misalignment angle between the axis of the rotary support means (spin axis) and the axis of rotation or geometric axis of the missile. This is what is termed a "repointing condition".

Heretofore, attempts to overcome the repointing condition were limited to dynamic balancing of the projectile itself. In other words, weight means were applied to the missile somewhat similar to the common balancing of a vehicle tire. This approach yielded usable accuracy results, but it is impractical to consider live warhead projectile dynamic balancing in a production environment.

The present invention is directed, generally, to a producibility sensitive alternative to dynamic balancing by a physical determination of the alignment of the spin axis of the rotary support means and the geometric axis of the projectile, and correcting any misalignment in a manner compatible with a production environment.

SUMMARY OF THE INVENTION

An object, therefore, of the invention is to provide a novel method of aligning the axis of rotation of a spin-stabilized self-propelled missile with the spin axis of its rotary missile support means.

Generally, in the exemplary embodiment of the invention, the missile is held in its rotary support means by a connection means operatively associated therebetween. The inventive method contemplates the steps of supporting the rotary missile support means and missile on a fixture for rotation about the spin axis of the support means. The rotary support means and missile then are rotated relative to the fixture about the spin axis. The amount of eccentricity between the missile axis of rotation and the spin axis then is determined. The missile is moved or adjusted relative to the rotary support means to colinearly align the missile axis of rotation and the spin axis. The connection means then is tightened to maintain the colinear alignment. This technique results in a production system whereby the assembled missile and rotary support means or turbine assembly can be readily mounted on their intended launching device without any other procedures such as static and dynamic balancing being required.

The invention also contemplates an apparatus for performing the alignment procedures, including a fixture having land means simulating the land means on the intended launching device for receiving and supporting the rotary missile support means, along with an integral measuring device for determining the eccentricity between the missile axis of rotation and the spin axis of the rotary missile support means. The fixture also includes side supports for containing the plane of eccentricity and a bottom support for controlling the adjustment motion in the plane of eccentricity.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 2:
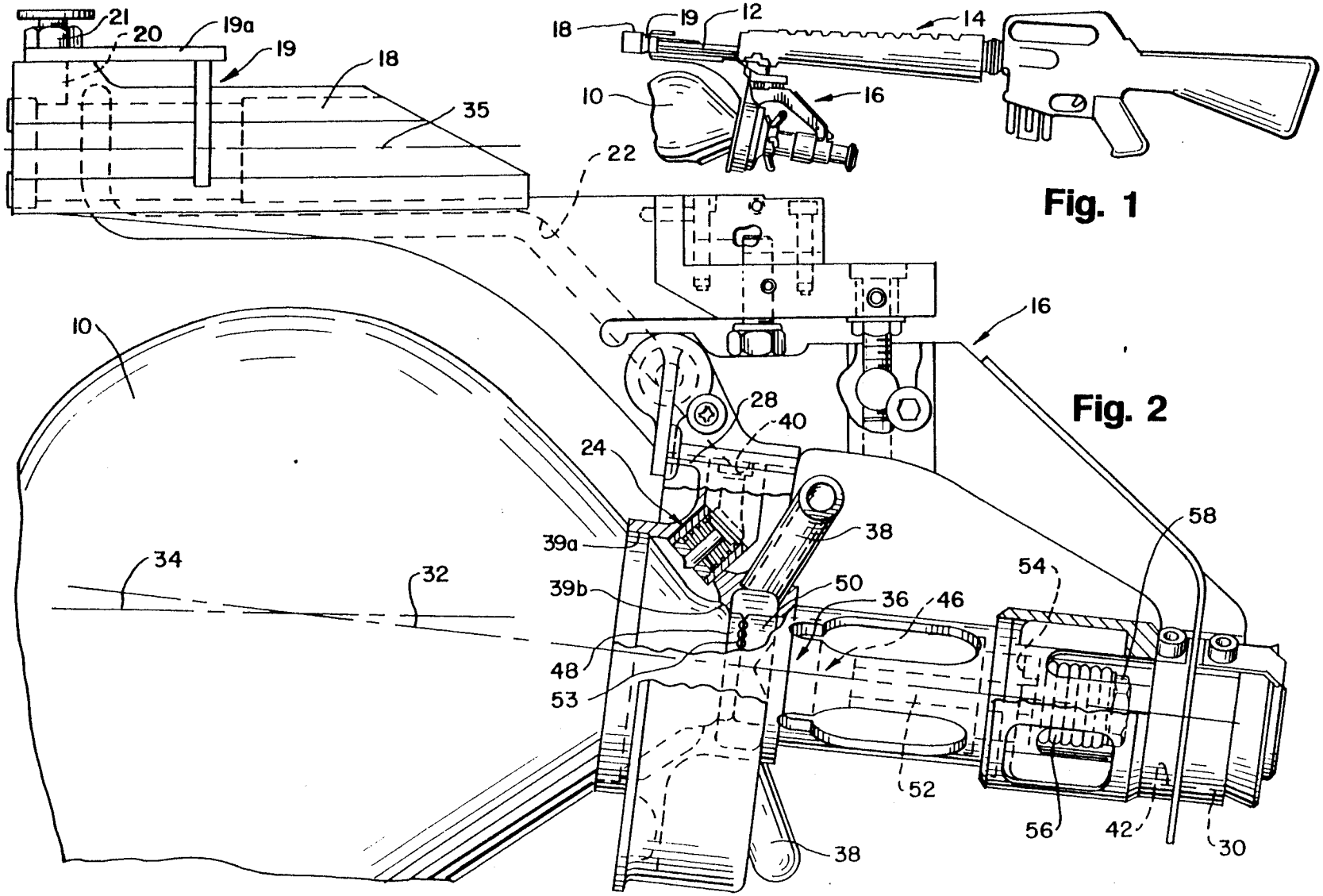
FIG. 1 is an elevational view of a spin-stabilized missile mounted on the barrel of a rifle and incorporating a release mechanism or launching apparatus for use with the alignment method and apparatus of the invention.
FIG. 2 is a fragmented side elevational view, partially in section and on an enlarged scale, showing some of the components of the missile and launching apparatus of FIG. 1 prior to ignition.

Referring to the drawings in greater detail and first to FIG. 1, a substantially spherical, spin-stabilized self-propelled missile 10 is shown mounted to the front of a barrel 12 of an assault weapon such as a rifle, generally designated 14. The rifle shown is a standard M-16A2 military rifle or any similar device. The deployment structure may be any fixed or portable structure, and the utility of the invention is not limited to a hand carried weapon such as a rifle.

As shown FIG. 1, and the enlarged view of FIG. 2, a missile support means, generally designated 16, include a front upper attachment portion 18 with axial motion restraint means, generally designated 19. Attachment portion 18 is generally tubular for positioning over barrel 12, and a tightening screw 20 fixes the attachment portion to the barrel. A nut 21 locks the axial restraint means 19 in place by retaining a clamp bar 19*a*. The attachment portion 18 is positioned on barrel 12 whereby part of the gas emanating from the barrel is channeled through a passageway 22 (FIG. 2) to a firing pin assembly, generally designated 24, which is effective to strike a primer on missile 10 to ignite the rocket propellant therein, as is known in the art.

Support means 16 also include turbine support land portions 28 and 30 (FIG. 3) which support the missile and release mechanism on an axis 32 upwardly inclined relative to an intended straight-line path of flight 34 generally parallel to the axis 35 of rifle barrel 12. As is known in the art, axis 32 is the spin axis of the missile and turbine assembly (described hereinafter); i.e., the motor thrust axis of the missile rocket motor. Axis 34 which defines the line of flight of the missile is the forward velocity or down range component thereof.

Generally, self-propelled missile 10 is a spinning projectile launched from essentially a zero-length launcher. In other words, this is in contrast to a bullet which travels through the entire length of the rifle barrel or launch tube. For accuracy and trajectory repeatability, the missile must be maintained in constant alignment with spin axis 32 during spin-up and release. Furthermore, since the rifle is fired and recoils during spin-up and release of the missile, the missile release must be practically instantaneous in order to prevent launcher/-projectile impulse moments from redirecting the missile during the release process. These problems are addressed in the aforesaid copending application Ser. No. 195,657 which is incorporated herein by reference. That invention has been shown to be effective in assuring an undisturbed spin-up and launch event superior to any prior art and, as stated above, the missile disengages in less than 0.5 msec.

Suffice it to say herein, and still referring specifically to FIG. 2, a rotary missile support means or turbine rotary assembly, generally designated 36, includes a plurality of turbine nozzles 38. Preferably, four nozzles are provided, 90° apart, to provide uniform and equalized torque transmission forces. Rotary missile support means 56 has annular registration surfaces 39*a* and 39*b* for registering with complementary registration surfaces on missile 10. In assembly, rotary missile support means 36 includes land portions 40 and 42 for precisely registering with complementary land portions 28 and 30, respectively, on support means 16. These land portions are concentric with spin axis 32.

A nozzle assembly, generally designated 46, includes a fore section 48 and an aft section 50 fixed to a rearwardly projecting bolt-like shaft 52 having an externally threaded rear end. A meltable joint 53 integrally joins fore and aft sections 48 and 50, respectively. Rotary missile support means 36 has an internal, radially inwardly projecting annular flange 54. A support or connection means in the form of a coil spring 56 is sandwiched between flange 54 and a tightening nut 58 threaded onto the rear end of shaft 52. Therefore, missile 10 and nozzle assembly 46 are held within missile rotary support means by spring 56 and nut 58. In other words, rotary missile support means 36 provides receptacle means for missile 10 and nozzle assembly 46 to support the missile and nozzle assembly on spin axis 32.

Figure 3:
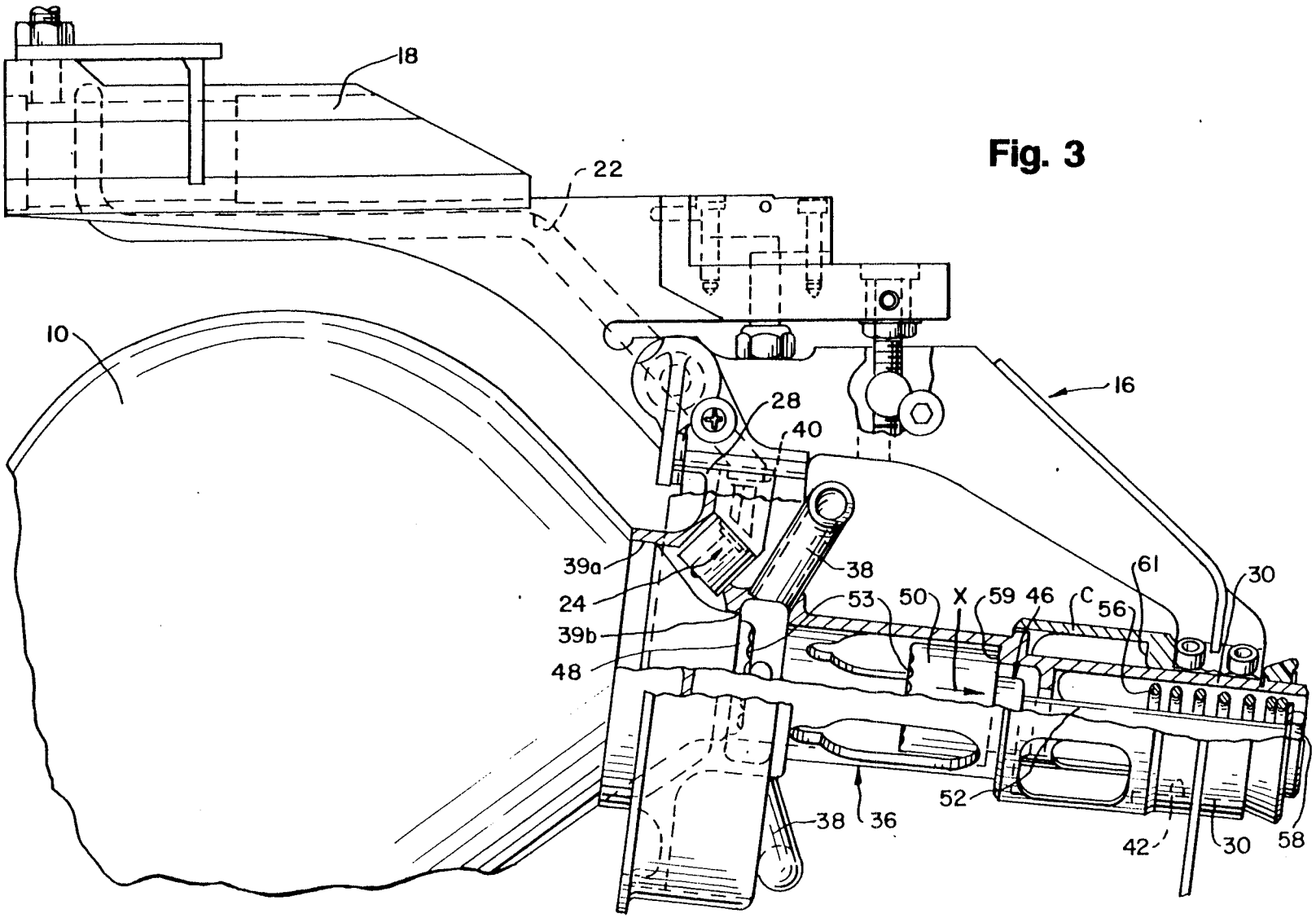
FIG. 3 is a view similar to that of FIG. 2, after separation of the fore and aft sections of the nozzle and on impact of the aft section with the launching apparatus.
Figure 4:
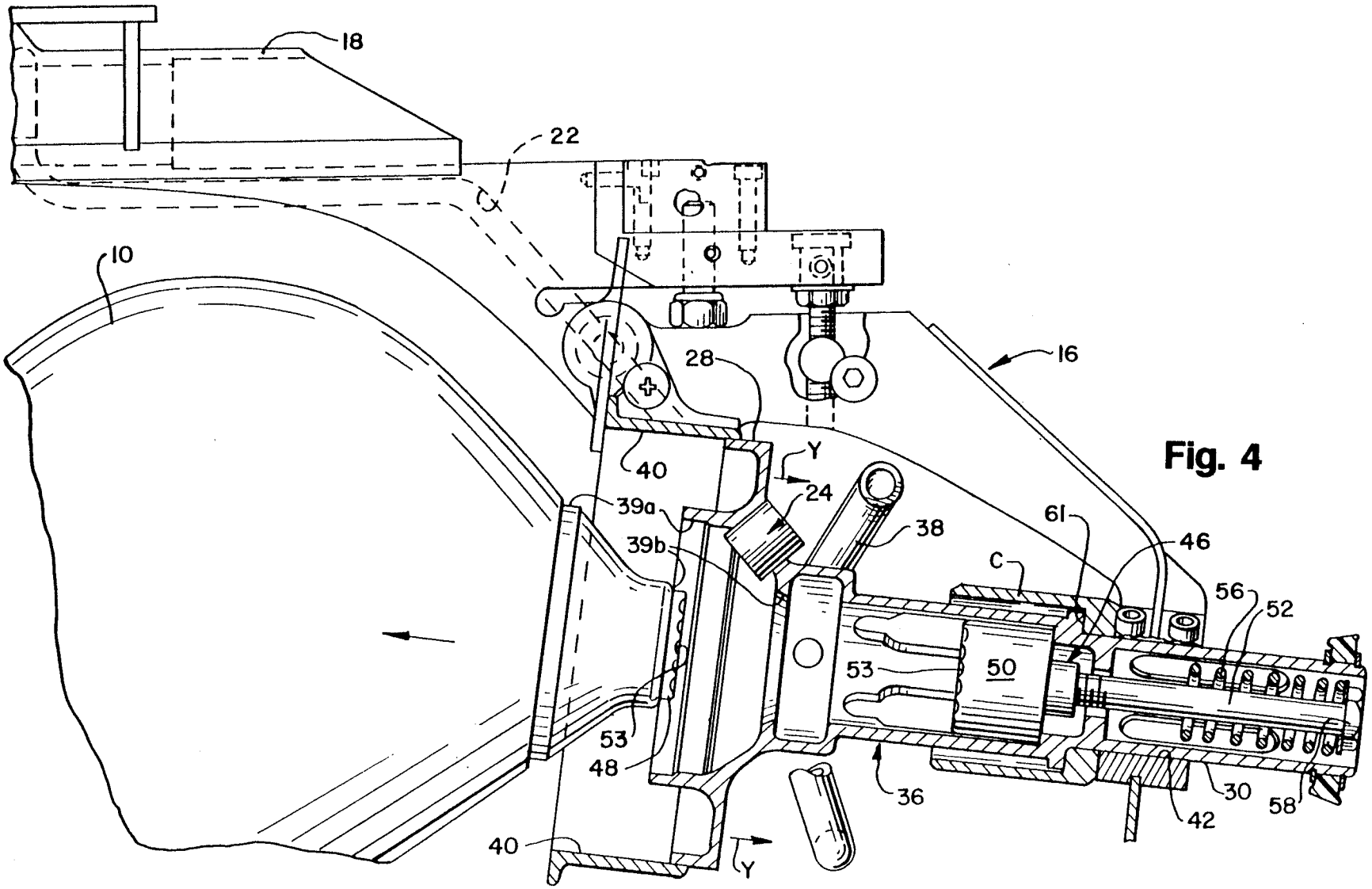
FIG. 4 is a view similar to that of FIGS. 2 and 3, showing the turbine assembly driven rearwardly against the launcher.

Very briefly, referring to FIG. 3, when meltable joint 53 separates, aft section 50 of nozzle assembly 46 is driven aftwardly in the direction of arrow "X" until it strikes turbine assembly 36 at shoulders 59. The turbine assembly then is driven aftwardly in the direction of arrows "Y" as shown in FIG. 4 until it is stopped by shoulders 61 on a locking collar "C".

As amplified to considerable extent heretofore, further problems exist when the axis of rotation of the missile is not colinear with spin axis 32. This can result from manufacturing tolerances, expansion and contraction allowances for temperature variances and other variables during manufacture whereby clearances result in the interfaces, such as registration surfaces 39*a* and 39*b* between missile 10 and rotary support means 36, as well as the interfaces between nozzle assembly 46 and the rotary support means 36. As a result, a "repointing condition" may occur during separation should the manufacturing assembly process cause the axis of rotation of the missile to vary from spin axis 32 of rotary support means 36, as allowed by the component design and fabrication tolerances. In order to alleviate these problems, and referring to FIG. 3, the invention contemplates a producibility system of aligning the missile and nozzle assembly with respect to the rotary support means prior to assembly on the intended launching device such as support means 16 on rifle 14.

To this end, the invention contemplates the provision of a fixture, generally designated 60 (FIG. 5), which has annular lands 62 and 64 precisely simulating lands 28 and 30 of the actual support means of the intended launching device. Fixture 60 has a base portion 68 (or any support structure) for rigidly supporting the fixture on an appropriate support structure 70. Frame portions 72 and 74 project upwardly from base 68 and terminate in and define annular lands 62 and 64, respectively. This rigid construction defines a spin axis 76 simulating spin axis 32 of rotary support means 36 when mounted on rifle support means 16 as described in relation to FIGS. 1 and 2. A frame arm 77 projects upwardly from land 62 and then forwardly and outwardly over an area where a missile 10 would be disposed when mounted in the fixture, as described below. A measuring gage, generally designated 78, is mounted on the forward distal end of frame arm 76 for quantifying missile and rotary means axes eccentricities.

As indicated in FIG. 3, missile 10 has a geometric axis 80 which runs from a geometric front center point 81 rearwardly through the center of gravity of the missile and through the axial center of nozzle 46. Ideally, missile axis 80 defines the axis of rotation of the missile when in flight and, ideally, should coincide with or be colinear with spin axis 76. However, most likely, missile axis of rotation 80 and spin axis 76 will be out of alignment when the missile and nozzle 46 are positioned within rotary missile support means 36, as indicated by the slight angle represented by arrows "D" (FIG. 3). As stated above, this misalignment results in a "repointing condition" during missile separation as the missile attempts to jump off of spin axis 76 and results in a "wobbling" effect during flight. Heretofore, the axes were aligned by dynamic balancing, similar to balancing an ordinary automobile tire and wheel, which does not lend itself to a practical production environment. This invention is directed to solving these problems and providing a capability of producibly controlling the alignment of missile axis of rotation 80 and spin axis 76, as in fixture 60, prior to mounting the missile in its appropriate launching device such as support means 16 on rifle 14.

Specifically, the method generally comprises the steps of providing a fixture, such as fixture 60, for receiving rotary missile support means 36, with missile 10 and nozzle means 46 positioned within the receptacle means defined by the support means, and supporting the rotary missile support means for rotation about its spin axis, i.e., axis 76. In other words, lands 40 and 42 of rotary support means 36 are positioned in lands 62 and 64, respectively, of the fixture. However, it should be noted that fixture 60 requires only two point contact at land area (64) and two point contact at land area (62) as long as the aft points are above spin axis 76 and the forward points are below the spin axis. Gravity loading with missile 10 in place will then provide spin axis 76 spacial defunction. Still generally, the rotary support means, with the missile and nozzle means positioned therein, then are rotated about axis 76 while positioned in the fixture. At this point, spring 56 is in the fully collapsed condition. As the rotary support means, nozzle means and missile are rotated, the amount of eccentricity between missile axis of rotation 80 and spin axis 76 is determined. This determination is made by gage 78 which has a projecting head 82 located at the maximum diameter of the missile taken generally perpendicular to its axis of rotation 80. The amount of eccentricity, or what is commonly termed "run out", of the missile axis and the spin axis can be determined by the amount the missile will move head 82 of gage 78 away from axis 76. For instance, as the missile rotates, its "run out" away from axis 76 will move head 82 upwardly in the direction of arrow "E".

Figure 5:
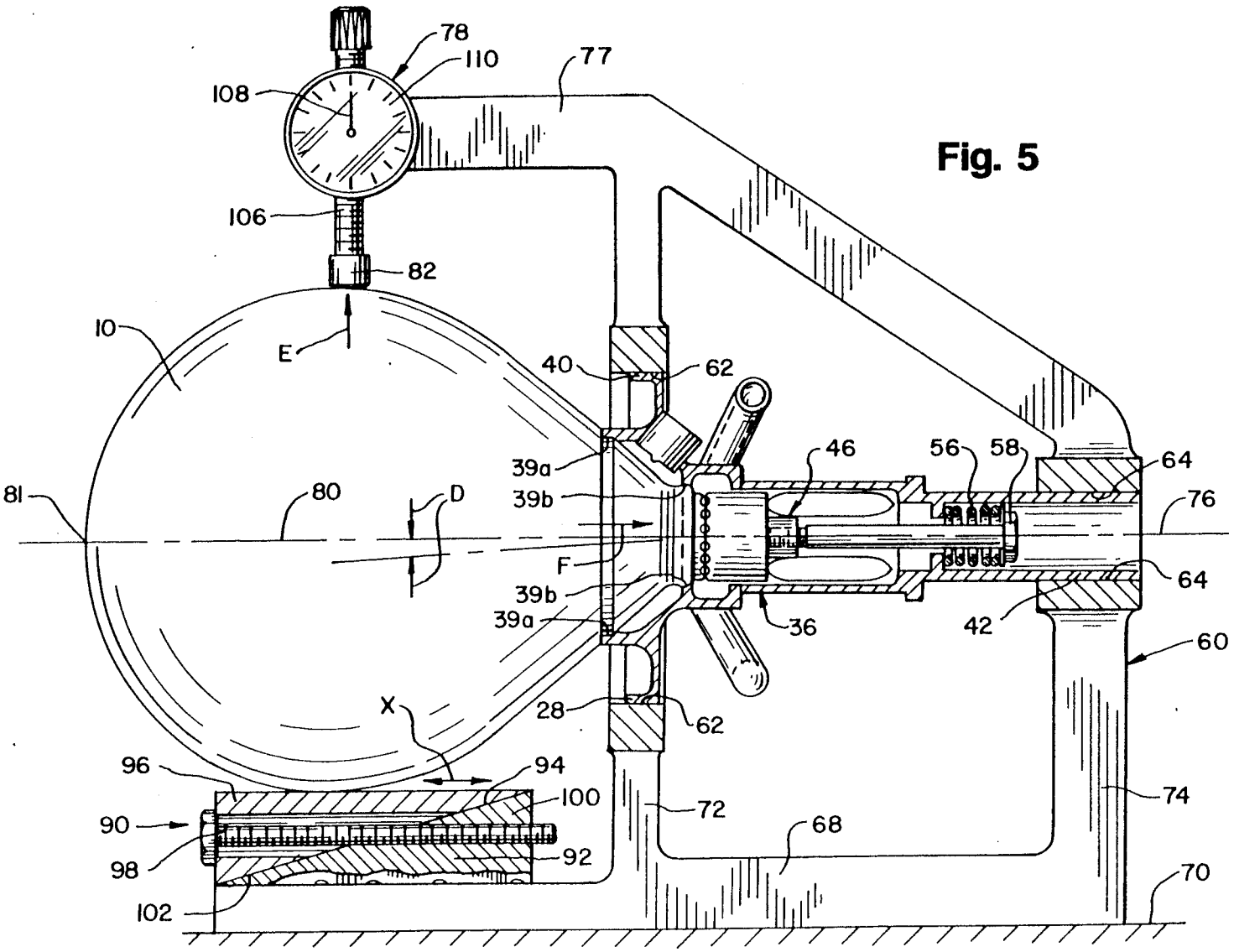
FIG. 5 is a vertical section through a fixture incorporating the concepts of the invention and for carrying out the method of the invention.
Figure 6:
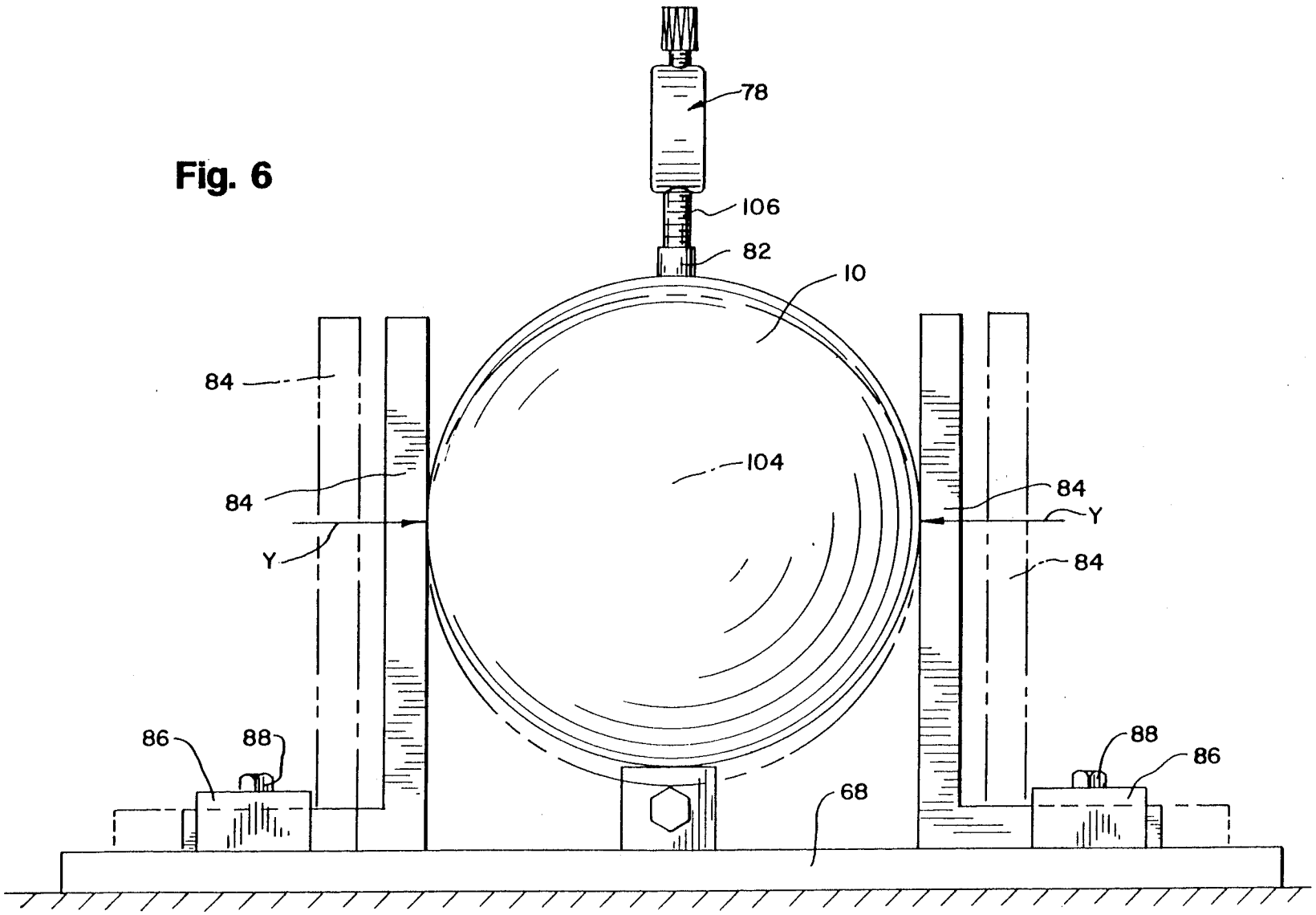
FIG. 6 is a front elevational view of the fixture of FIG. 5.

More particularly, referring to FIG. 6 in conjunction with FIG. 5, fixture 60 has a pair of L-shaped side supports 84 slidably mounted on base 68 by appropriate bracket means 86 fixed to the base, and including any appropriate means, such as set screws 88 threaded in the bracket means, for securing the side supports in any position of adjustment relative to base 68. These side supports are provided for containing the plane of eccentricity of missile 10. Referring back to FIG. 5, an adjustable bottom support, generally designated 90, is provided for controlling the adjusting motion of missile 10 in the plane of eccentricity confined by side supports 84. Bottom support 90 includes a fixed block 92 secured to base 68 and including a rearwardly inclined ramp surface 94 on top of the fixed block. An adjusting block 96 has a screw 98 extending therethrough and threaded through an upwardly projecting flange portion 100 of fixed block 92. Adjusting block 98 has a bottom angled cam surface 102 which rides up ramp surface 94 of fixed block 92. With this construction, rotation of screw 98 will cause adjusting block 96 to move in the direction of double-headed arrow "X" whereby adjusting block 96 can move vertically for engaging the underside of missile 10 and thereby providing a bottom support for the missile.

With side supports 84 in an "open" position as shown in phantom in FIG. 6, and with adjusting block 96 moved forwardly (to the left in FIG. 5), the invention contemplates a procedure for aligning missile 10 in rotary support means 36 as now described. First, missile 10 is loaded into rotary support means 36, and the missile/support means assembly is loaded into fixture 60 as described above, with spring 56 in collapsed condition. The missile/support means assembly then is rotated to determine a plane of its high point and its low point in relation to a vertical direction. This best can be understood with reference to FIG. 6 wherein the "high point" of the missile is shown in full lines and the "low point" of the missile is shown in phantom, thereby defining a vertical plane of eccentricity designated 104. In other words, the assembly should be rotated so that its high point (of the missile) is at the top/dead-center of plane 104. These high and low positions easily can be determined by gage 78, with head 82 riding on the top of the missile. Head 82 may be on a distal end of a plunger 106 (FIG. 5) which is effective to rotate an indicating needle 108 relative to a dial 110.

Once the high point and low point of the missile are determined by using gage 78, the missile is rotated so that it is at its "low point" as indicated by the dial and generally represented in phantom in FIG. 6. Side supports 84 then are closed inwardly until they contact the sides of missile 10 to contain and restrain the missile horizontally relative to the fixture. The side supports are locked in place relative to base 68 by set screws 88. Adjusting block 98 (FIG. 5) of bottom support 90 then is moved up ramp surface 94 until it contacts the bottom of missile 10. Spring 56 then is loosened and adjusting block 96 is moved further to move the missile upwardly to a point half-way between the previously determined high and low points. The spring then is tightened. The side and bottom supports then are moved away from the missile and the missile is rotated to test for any eccentricity. If any eccentricity still appears by reading movement of needle 108 of gage 78, the above steps can be repeated as required.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. For use with a launching apparatus for a spin-stabilized self-propelled missile, which includes rotary missile support means having receptacle means defining a spin axis, the missile having nozzle means extending into the receptacle means and defining a missile axis of rotation, and connection means operatively associated between the rotary missile support means and the nozzle means for holding the nozzle means and, thereby, the missile in the receptacle means, a method of aligning the missile axis of rotation with the spin axis of the rotary missile support means, comprising the steps of:

providing a fixture for receiving the rotary missile support means with the missile and nozzle means positioned in the receptacle means and supporting the support means for rotation about its spin axis;

supporting the rotary missile support means on the fixture;

rotating the rotary missile support means and the missile relative to the fixture about said spin axis;

determining the amount of eccentricity between the missile axis of rotation and said spin axis;

moving the missile and nozzle means relative to the rotary support means to coincidently align the missile axis of rotation and said spin axis; and tightening said connection means to maintain said coincident alignment of the axes.

2. The method of claim 1 wherein the rotary support means has land means concentric with its spin axis for mating with complementary land means on its intended launcher device, and including providing said fixture with land means simulating said complementary land means on the launcher device, and said supporting step comprises supporting the rotary missile support means on the fixture with their respective land means mated.

3. The method of claim 1 wherein the missile is substantially spherical, and said determining step is carried out at a diameter of the missile perpendicular to the missile axis of rotation.

4. The method of claim 1 wherein said determining step is carried out along a line generally perpendicular to said spin axis.

5. The method of claim 4 wherein the missile is substantially spherical, and said determining step is carried out at a diameter of the missile perpendicular to the missile axis of rotation.

6. The method of claim 1, including restraining the missile on the fixture in a plane of maximum eccentricity before moving the missile relative to the rotary support means.

7. For use with a launching apparatus for a spin-stabilized self-propelled missile, which includes rotary missile support means defining a spin axis and receiving the missile with a missile axis of rotation, and connection means operative to hold the missile on the support means, a method of aligning the missile axis of rotation with said spin axis, comprising the steps of:

supporting the rotary missile support means and missile on a fixture for rotation about said spin axis;

rotating the rotary missile support means and missile relative to the fixture about said spin axis;

determining the amount of eccentricity between the missile axis of rotation and said spin axis;

adjustably moving the missile relative to the rotary support means to coincidently align the missile axis of rotation with said spin axis; and tightening said connection means to maintain said coincident alignment of the axes.

8. The method of claim 7 wherein the rotary support means has land means concentric with its spin axis for mating with complementary land means on its intended launcher device, and including providing said fixture with land means simulating said complementary land means on the launcher device, and said supporting step comprises supporting the rotary missile support means on the fixture with their respective land means mated.

9. The method of claim 7 wherein the missile is substantially spherical, and said determining step is carried out at a diameter of the missile perpendicular to the missile axis of rotation.

10. The method of claim 7, including repeating said determining step and said moving step before tightening said connection means.

11. The method of claim 7, including restraining the missile on the fixture in a plane of maximum eccentricity before moving the missile relative to the rotary support means.

12. The method of claim 7 wherein said determining step is carried out along a line generally perpendicular to said spin axis.

13. The method of claim 10 wherein the missile is substantially spherical, and said determining step is carried out at a diameter of the missile perpendicular to the missile axis of rotation.

14. For use with a launching apparatus for a spin-stabilized self-propelled missile, which includes rotary missile support means defining a spin axis and receiving the missile with a missile axis rotation, and connection means operative to hold the missile on the support means, an apparatus for aligning the missile axis of rotation with said spin axis, comprising:

a fixture for supporting the rotary missile support means and missile for rotation about said spin axis; and means on the fixture for determining the amount of eccentricity between the missile axis of rotation and the spin axis whereby the missile can be moved relative to the rotary missile support means, while supported on the fixture, to coincidently align the missile axis of rotation and the spin axis.

15. The apparatus of claim 14 wherein the rotary support means for the missile has land means concentric with its spin axis for mating with complementary land means on its intended launcher device, and said fixture includes land means simulating said complementary land means on the launcher device for supporting the rotary missile support means on the fixture with their respective land means mated.

16. The apparatus of claim 14 wherein said means for determining is located on a diameter of the missile perpendicular to the missile axis of rotation.

17. The apparatus of claim 14 wherein said means for determining is located on a line generally perpendicular to said spin axis.

18. The apparatus of claim 14, including means for constraining the missile in a plane of its maximum eccentricity.

* * * * *